US006454542B1

(12) United States Patent
Back

(10) Patent No.: US 6,454,542 B1
(45) Date of Patent: Sep. 24, 2002

(54) HYDRAULIC CYLINDER POWERED DOUBLE ACTING DUPLEX PISTON PUMP

(75) Inventor: Carl F. Back, Findlay, OH (US)

(73) Assignee: Laibe Corporation, Indianapolis, IN (US)

( * ) Notice: Subject to any disclaimer, the term of this patent is extended or adjusted under 35 U.S.C. 154(b) by 0 days.

(21) Appl. No.: 09/723,673

(22) Filed: Nov. 28, 2000

(51) Int. Cl.[7] ..... F04B 1/00
(52) U.S. Cl. ..... 417/53; 417/342; 91/275
(58) Field of Search ..... 417/53, 347, 403, 417/404, 536, 342; 91/275, 514, 515

(56) References Cited

U.S. PATENT DOCUMENTS

| | | | | | |
|---|---|---|---|---|---|
| 3,997,007 | A | * | 12/1976 | Junck et al. | 172/812 |
| 4,470,771 | A | * | 9/1984 | Hall et al. | 417/342 |
| 4,477,232 | A | * | 10/1984 | Mayer | 417/342 |
| 4,490,096 | A | * | 12/1984 | Box | 417/342 |
| 4,500,267 | A | | 2/1985 | Birdwell | 417/552 |
| 4,541,779 | A | | 9/1985 | Birdwell | 417/62 |
| 5,209,649 | A | * | 5/1993 | Dose et al. | 417/342 |
| 5,238,371 | A | | 8/1993 | Benckert | 417/345 |
| 5,616,009 | A | * | 4/1997 | Birdwell | 417/342 |
| 6,171,075 | B1 | * | 1/2001 | Munzenmaier et al. | 417/342 |

* cited by examiner

*Primary Examiner*—Teresa Walberg
*Assistant Examiner*—Quang Van
(74) *Attorney, Agent, or Firm*—Woodard, Emhardt, Naughton, Moriarty & McNett

(57) ABSTRACT

A mud pump is provided with two cylinders for pumping mud in connection with water well drilling, and two sets of hydraulic oil cylinders with pistons connected to and driving the pistons of the mud pump by piston rod connecting plates. A flow divider located downstream from a hydraulic oil power supply pump applies hydraulic power evenly to two sets of mud pump driving cylinders, but the flow divider accommodates re-routing of hydraulic oil to one driving cylinder during a directional valve shift for the other driving cylinder. Rod position sensing switches coupled to an electro-hydraulic control system coordinates the action of the sets of pump driving cylinders and thereby of the mud pumping cylinders, to control and phase the mud driving pistons produce a steady mud pump output simulating the effect of constant velocity pistons.

22 Claims, 11 Drawing Sheets

HYDRAULIC CYLINDER POWERED DOUBLE ACTING DUPLEX PISTON PUMP

BACKGROUND OF THE INVENTION

1. Field of the Invention

This invention relates generally to piston pumps for the water well drilling industry, and more particularly to a hydraulic cylinder powered double acting duplex piston pump.

2. Description of the Prior Art

Double acting duplex piston pumps are well known and have been used in the water well drilling industry for many years. Typically they employ a crankshaft and flywheel driven in various ways, a reciprocating engine or a hydraulic motor being examples. Typically, they are heavy units with a large component of cast iron. Today's well drilling trucks carry lengths of drilling pipe, as well as derricks, motors, pumps of various kinds, and the "mud" pump. The current double acting duplex piston pumps with crankshaft and flywheel, being very heavy, contribute significantly to the weight and space requirements of the truck. They impact the ability of a truck to meet federal highway weight restrictions. Also, the mechanical crank throw design imparts a variable speed to the mud pump piston. In such designs, the piston is either accelerating or decelerating during a large part of its design stroke. So the piston operates at its full design capacity during only a portion of the stroke. Therefore, it is an object of the present invention to provide a duplex piston pump useful as a mud pump on a water well drilling machine, but without a motor, crankshaft, flywheel, gearing, and/or belts, for a significant weight reduction.

SUMMARY OF THE INVENTION

Described briefly, according one embodiment of the present invention, a mud pump is provided with two working cylinders for pumping mud, and two sets of double-acting hydraulic driving cylinders. One set of two driving cylinders has the piston of each connected to the piston of one double-acting mud pump cylinder. The other set of two driving cylinders has the piston of each connected to the piston of the other double-acting mud pump cylinder. The connection of a set of driving cylinder pistons to the mud pump piston is through a member which allows side-by-side, or over and under parallel arrangement of the driving cylinders and mud pump cylinders, so the overall length is minimal. An electro-hydraulic control system is provided to coordinate the action of the pump driving cylinders with the mud pumping cylinders for contributing to steady flow of mud from the mud pump.

DESCRIPTION OF THE ILLUSTRATED EMBODIMENT

Figure 1:
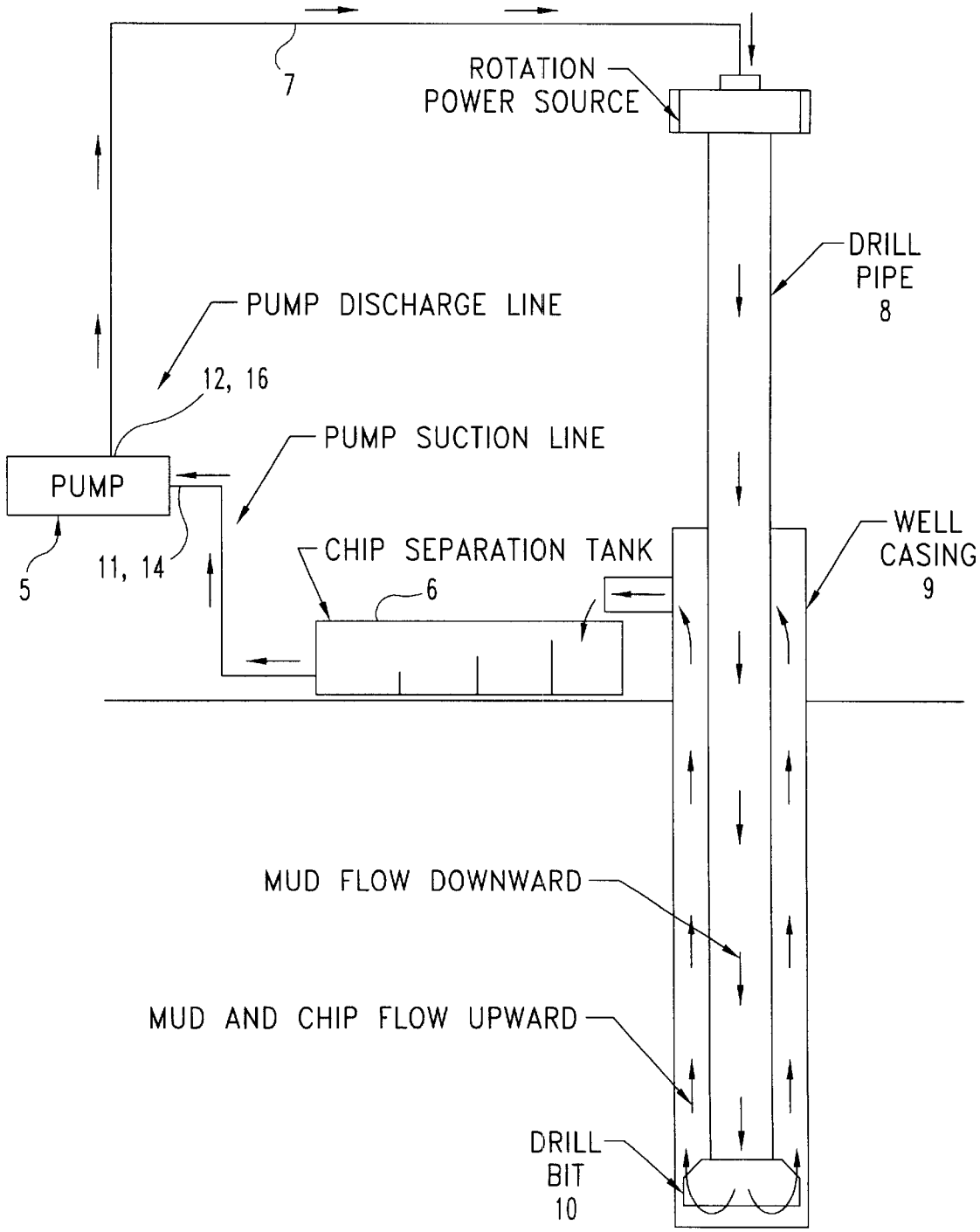
FIG. 1 is a schematic diagram of a typical application environment for the pump of this invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

FIG. 1 shows, schematically, a normal environment in which the mud is pumped by duplex piston pump 5 of the present invention from the chip separation tank 6 through the pump and the discharge the line 7 into the top of drill pipe 8 and down in the drill pipe and out into the well casing at the drill bit 10. The mud flows upward through the casing and back into the separation tank 6. The pump itself includes two mud pumping cylinders 1 and 2 fixed relative to a base 3 (FIGS. 5A and 5B) by mounting to four housings 4L, 4F, 4R and 4B which are fixed to the base.

As suggested above, according to the present invention, an all-hydraulic drive for the two mud-pumping pistons in cylinders 1 and 2 is achieved. For that purpose, and referring to FIG. 3, a variable volume hydraulic pump P is used. It can be set, for example, at a rate of 36 gallons per minute at 1,000 psi. A motor M can be used to drive such a pump, and such pumps and drives for them are known in the art and readily available. The pump output is fed to a flow divider D. This is not merely a device to split the flow. Instead, it has a piston inside which will shift in either direction to the extent necessary as it tries to be sure that the exact same volume flow rate is delivered at both output ports of the flow divider. An example of such a flow divider is Model MH2FA by Rexroth Worldwide Hydraulics.

Figure 2:
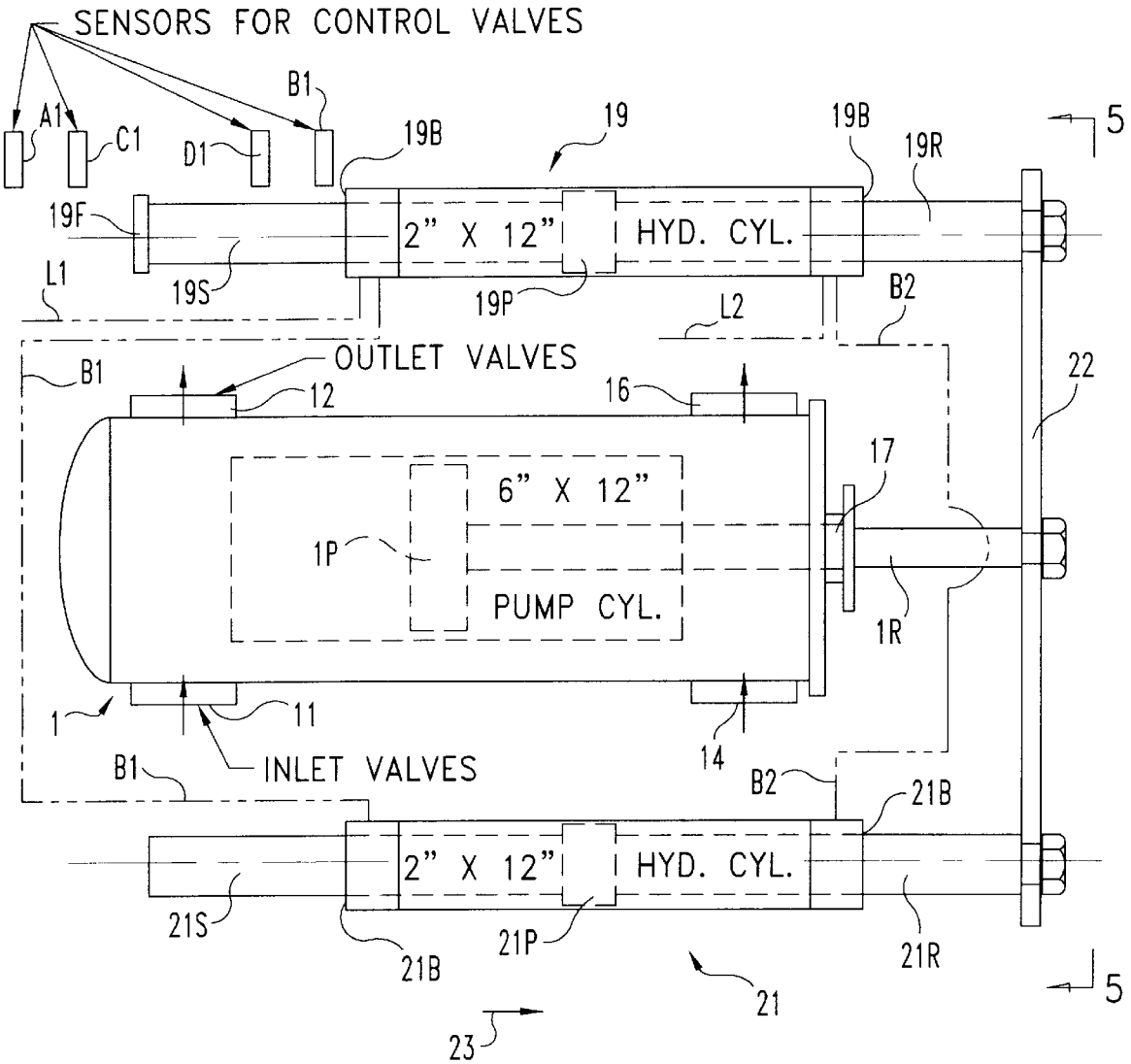
FIG. 2 is a schematic elevational view of one of the two pump assemblies of the duplex piston pump according to one embodiment of the present invention.
Figure 5A:
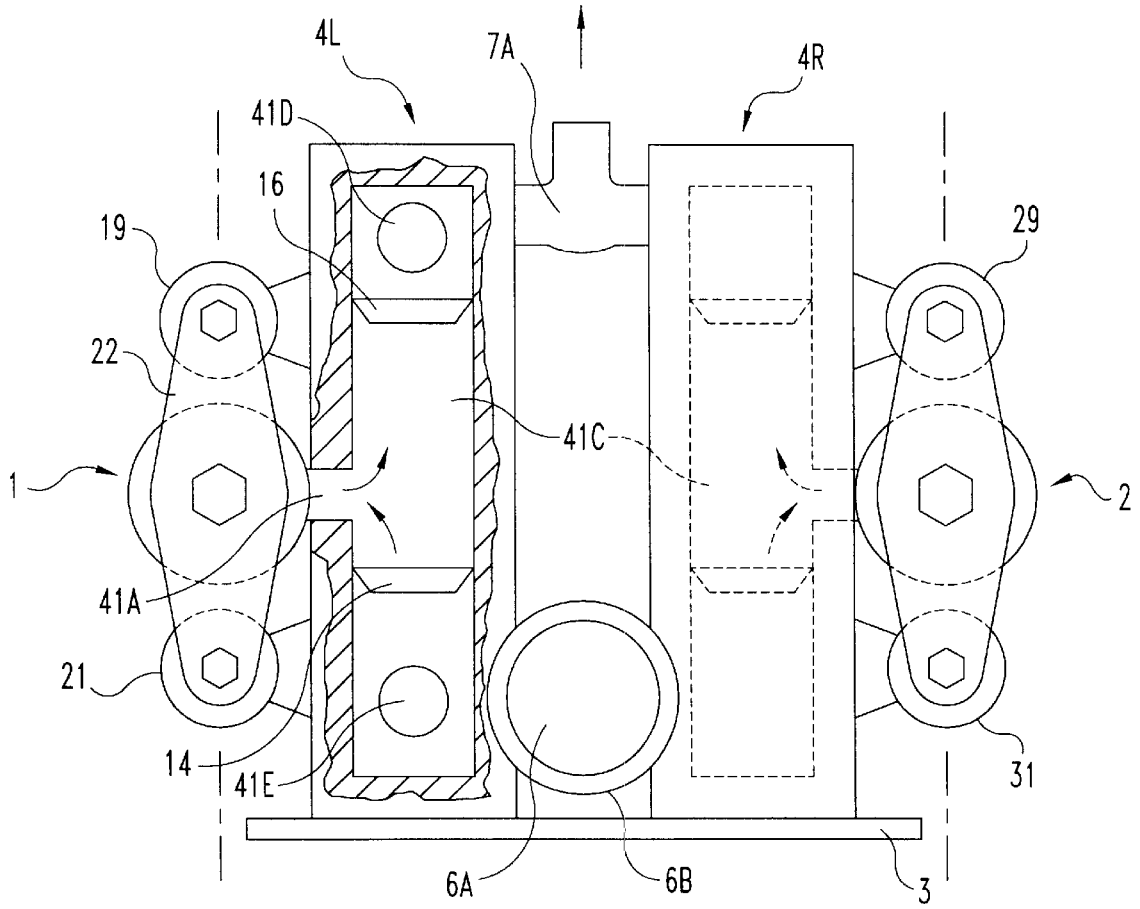
FIG. 5A is a schematic rod end view of the duplex pump.

Before proceeding further with this description, it is important to understand that each half of the duplex piston pump includes a double-acting mud pump cylinder and piston assembly. FIG. 2 shows one of the halves including mud pump cylinder 1. The other half, including a mud pump cylinder and associated hydraulic driving cylinders is identical. FIG. 5A shows, schematically, a rod end view of the duplex piston mud pump 5 including the mud pump cylinders 1 and 2 and associated driving cylinders of both halves.

Figure 5B:
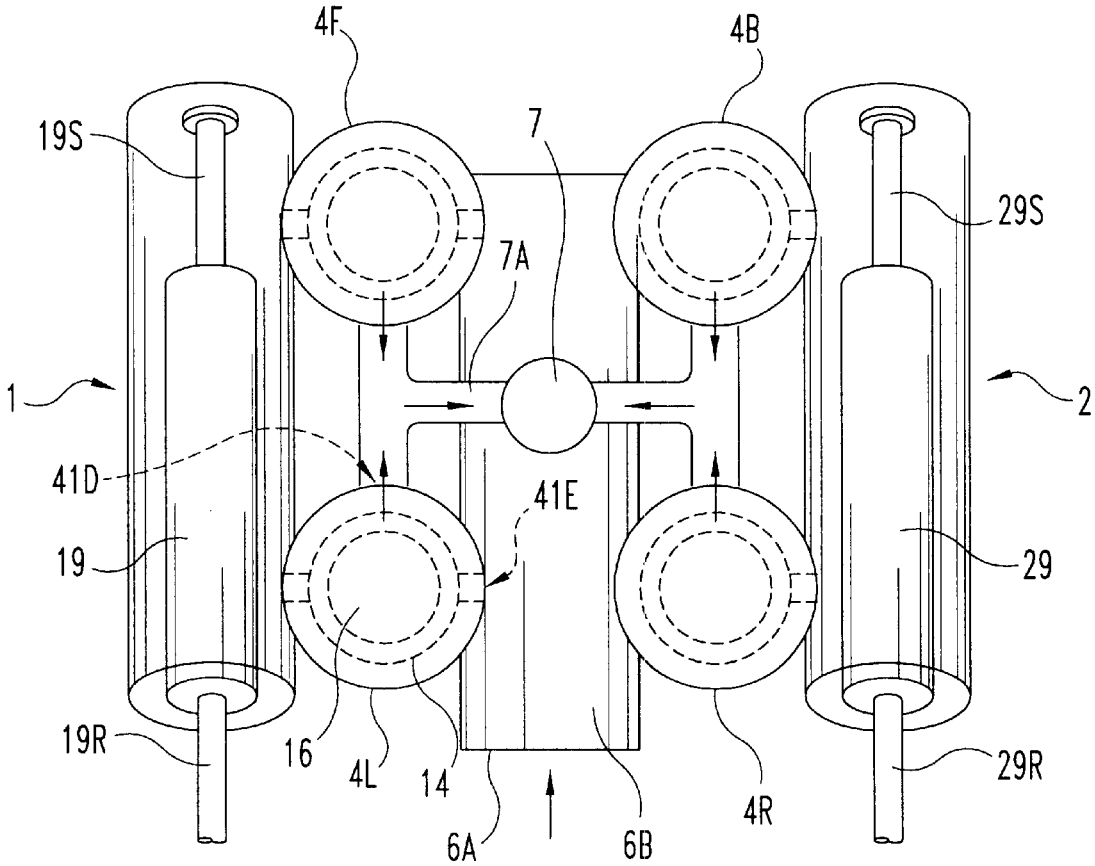
FIG. 5B is a schematic top view of the duplex pump.
Figure 6:
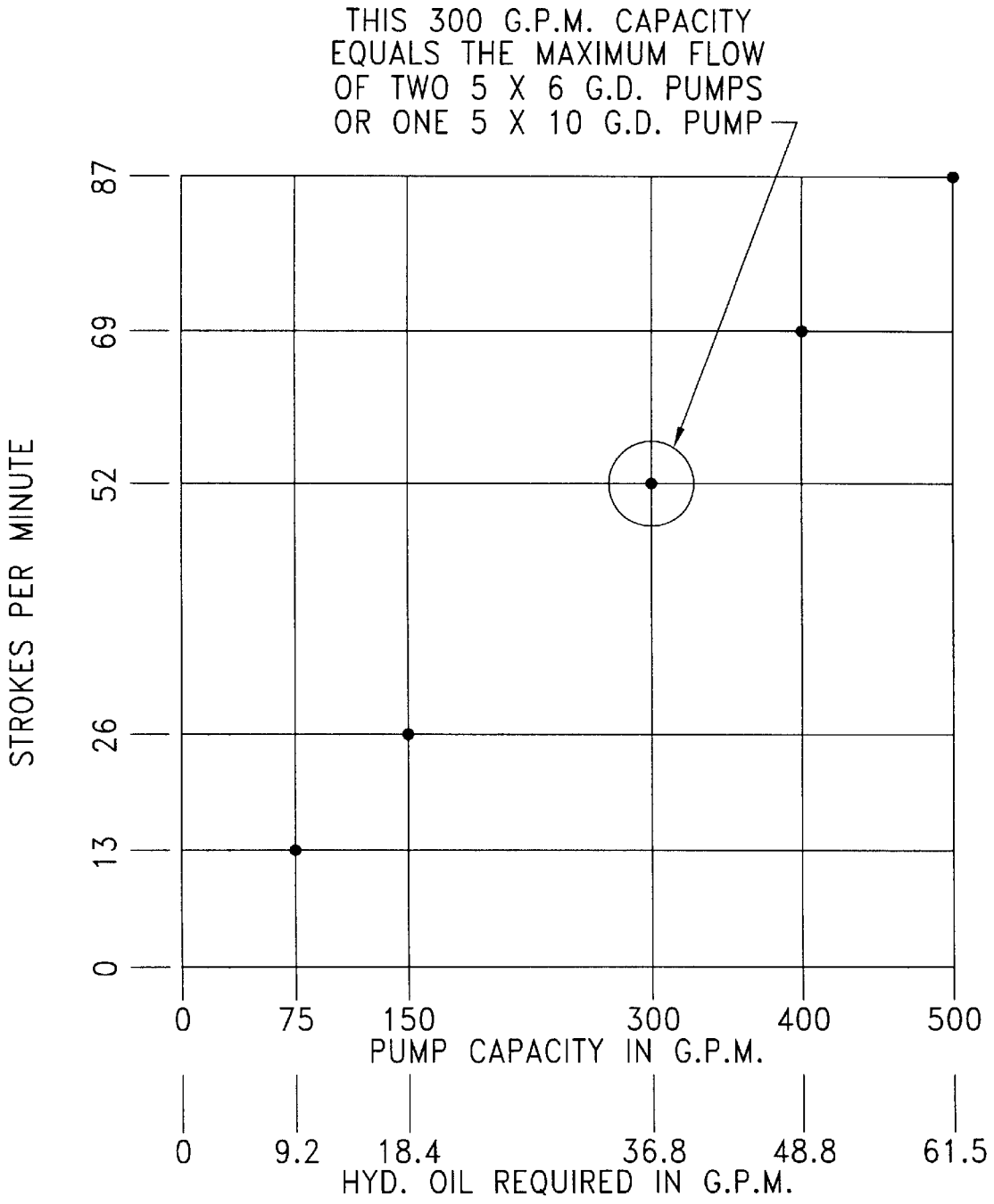
FIG. 6 is an example of a flow chart relating mud pump speed to mud pump output volume capacity and hydraulic driving oil volume requirement for a pump according to the illustrated embodiment of the present invention.

The mud pump cylinders and their associated driving cylinders may be fixed relative to each other and mounted to the base 3 by any suitable means. The schematics of FIGS. 5A and 5B show, as an example, the four valve housings 4F, 4L,4B and 4R fixed to base 3. Except for right and left ports, each of these housings is the same as the others, and includes therein a chamber such as 41C having an opening 41A communicating with a port of a mud pump cylinder such as cylinder 1 or 2. Each chamber 41C also has two other openings. One of them is fitted with a one-way, spring loaded outlet valve such as 16 to enable mud to move from chamber 41C into the upper end of housing 4L and out through port 41D into the discharge plenum 7A. The other opening 41E of chamber 41C is fitted with a spring loaded inlet valve such as 14 communicating with the lower end of housing 4L and enabling mud entering suction inlet 6A of the mud suction manifold 6B to enter through port 41E in housing wall and into chamber 41C. The mud pump cylinders are attached to their respective valve housings in conventional manner with the ports of the cylinders communicating with the respective chambers of the housings.

Referring now to FIGS. 2 and 5A and 5B together, FIG. 2 shows schematically mud pump cylinder 1 and inlet and outlet valves 11 and 12, respectively, associated with the pump port at one end of cylinder 1, and inlet and outlet valves 14 and 16, respectively, associated with the pump port at the opposite end of cylinder 1, the rod-end of the cylinder. In practice since there would normally be only one port at each end of the cylinder, the valves would be in the housings 4L and 4F for cylinder 1. There is a packing gland 17 at the rod-end of the cylinder. In FIG. 5B the top of housing 4L is cut away to show discharge valve 16. Suction or inlet valve 14 below chamber 41C is shown larger in dashed lines to be able to see it in FIG. 5B, as it is the bottom of chamber 41C, FIG. 5A.

According to one feature of this invention, there are two hydraulic driving cylinder/piston assemblies 19 and 21 arranged in a way to drive the mud pump piston 1P in cylinder 1. As suggested above, cylinders 1, 19, and 21 are all connected relative to each other by some suitable means (brackets and/or clamps, for example) so that they are longitudinally immovable relative to one another. This is represented schematically for both sets of mud pump and driving cylinders at the valve housing 4L, 4R and associated inlet and outlet and base in FIGS. 5A and 5B, to which all of the six cylinders of both halves of the duplex pump are rigidly, but removably connected. Each of the two driving cylinder assemblies for piston 1P has a piston rod such as 19R and 21R bolted to a rod connector plate 22. Each rod may extend through the piston and exit the driving cylinder at the end opposite the plate-connected rod end, as indicated at 19S and 21S. The respective pistons 19P and 21P are affixed and sealed to the rod in a suitable way and may be of any suitable construction. Of course, the same effect may be achieved using separate colinear rods secured to opposite faces of the pistons. The piston rods 19R and 21R of the driving cylinders for mud pump cylinder 1, and rod 1R of the mud pump cylinder 1 itself, are bolted to the rod connector plate 22. Each of the rods 19R, 19S and 21R, 21S is supported at opposite ends of the respective cylinder by bearings and seals at 19B and 21B, respectively. Using double rod cylinders provides equal working area on the two sides of the piston, enabling equal oil flow and thrust capacity in both directions of piston travel. One or the other of the driving cylinder rods for mud pump cylinder 1 is associated with a set of proximity sensing switches A-1, B-1, C-1, and D-1 to operate a relay to shift a hydraulic solenoid valve spool to control hydraulic fluid to and from the set of two driving cylinders 19 and 21 to drive the mud pump 1. The same kind of arrangement is provided for mud pump cylinder 2. For each set, the driving cylinder which has the associated proximity switches, may be referred to hereinafter from time-to-time, as the control cylinder.

In this particular arrangement, only as an example of cylinder and rod size, the mud pump cylinder may be six inches in diameter with a twelve inch stroke, using the pistons of two driving cylinders of two inch diameter each to drive the one mud pump piston. A significant advantage can be achieved by making the rods of the driving cylinders larger in diameter (1.375 inches, for example) than that of the mud pump cylinder rod (1.25 inches, for example). It enables use of larger and longer wearing bearings in the driving cylinders, and enables the use of a relatively small piston rod and packing gland 17 in the mud pump cylinder, thus minimizing exposure to wear of the packing gland. The combination of the large diameter rods in the driving cylinders, fixed to a rigid rod connector plate 22 to which the mud pump cylinder rod is bolted, contributes to a very rigid structure. It avoids the necessity of a very long arrangement and long piston rod spans which would be necessary if the mud pump cylinder was driven by a single piston in a hydraulic cylinder on the same longitudinal axis. That would require a more complicated bearing arrangement to support the mud pump cylinder rod. In the present arrangement, the cylinder rod bearings are relatively close to the mud pump packing gland, helping extend the life of the gland by minimizing radial working and resulting loading of the mud pump rod on the packing gland. Also, with the present arrangement, the driving cylinder rods are in tension when the mud pump rod is in compression, which reduces the bending moment.

The proximity sensor switches A-1 through D-1 are responsive to movement of an actuator such as flange 19F on rod 19R, 19S. These switches may be normally-closed or normally-open switches as a matter of convenience in the construction of the circuitry. It should be understood, of course, that the other half of the duplex double acting pump assembly which includes cylinder 2, has driving cylinders such as 29 and 31 associated with it, and proximity switches associated with the piston rod of one (29, for example) of those driving cylinders, (shown in FIGS. 3 and 5A) in the same manner as for the assembly shown in FIG. 2. The position of the piston in cylinder 1 is preferably in a different location and/or it is moving in a different direction, from that of the piston in cylinder 2.

Figure 3:
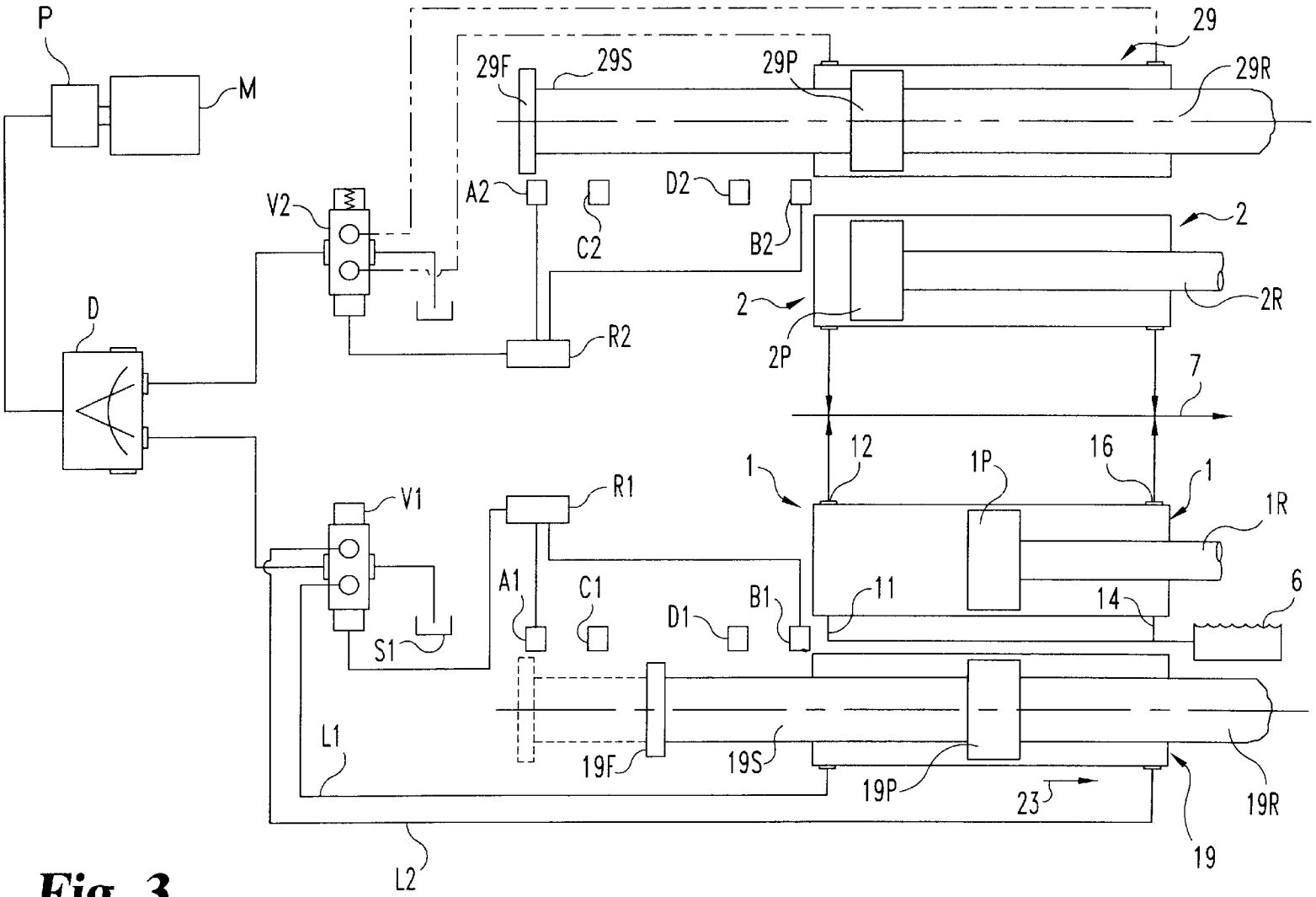
FIG. 3 is a schematic diagram of a system according to the illustrated embodiment and showing both of the duplex mud pump cylinders, with one of two hydraulic driving cylinders for each of the mud pump cylinders, and including an organization of hydraulic flow divider, rod position sensing, proximity-type electrical switches and associated electrical relays for solenoid-operated hydraulic fluid directing spool valves associated with the hydraulic cylinders.

Referring now to FIG. 3, mud pump cylinder 1 and mud pump cylinder 2 are shown schematically, as is one cylinder of each set of two driving cylinders for each of the two mud pump cylinders 1 and 2, respectively. Since the mud pump cylinders are virtually identical and the two driving cylinders of the set for each of the mud pump cylinders are virtually identical, a description of one driving cylinder and associated controls will suffice for both.

The output from flow divider D enters the center input port of a two-position, solenoid-actuated, spring-return hydraulic valve V-1. This valve is electrically coupled to a relay switch R-1 which is bi-stable and electrically coupled to the proximity sensor switch A-1. An example of a suitable relay is No. 700-HJD32Z12 by Allen-Bradley. It is a DPDT latching relay. One switched position of this relay switch R-1 causes the solenoid to be energized to open the valve and supply pressurized oil from valve V-1 through line L-1 to the one end of cylinder 19 and likewise cylinder 21 of FIGS. 2 and 5 to drive the pistons in the direction of the arrow 23. This occurs in both driving cylinders 19 and 21, so rod 13R, being mechanically fixed to the two driving cylinder rods 19R and 21R by rod connector plate 22, is likewise driven in the direction of the arrow 23. When relay R-1 is reset by a signal from another proximity switch which can be recognized upon study of FIGS. 4A through 4D, it de-energizes the solenoid for valve V-1, enabling the spring therein to return the solenoid to position where the supply to the cylinder 19 is through line L-2, to reverse the direction of the piston in that cylinder and its companion driving cylinder, thus reversing the direction of the mud pump piston 1P. Whichever side of the piston is not pressurized at any time is enabled to dump through the valve V-1 to sump S-1. Essentially the same arrangement exists for control and drive of mud pump cylinder 2. In this instance, the proximity switches are designated A-2, B-2, C-2 and D-2. The relay switch is R-2 and the control valve is V-2 operated by a solenoid. It should be mentioned at this point, however, that while the pistons in the driving cylinders for one of the mud pump cylinders are located in the same relationship to each other as the mud pump cylinder with which they are associated, they are typically out of phase with respect to the mud pump piston and pistons of associated drive cylinders of the other mud pump cylinder. This is intentional in an effort to be sure that the flow out of the mud pump assembly 5 is as stable and constant as possible. That is the goal to which the organization of the proximity switches and associated relay switches are directed. Also with reference to FIGS. 2 and 3, it should be mentioned that the supply lines L-1 and L-2 to cylinder 19 are larger than the lines from cylinder 19 to cylinder 21. This is because the lines from valve V-1 go directly to only one of the two driving cylinders and from that point, are directed to the other driving cylinder. Thus, the supply lines L-1 and L-2 must be large enough to drive both driving cylinders 19 and 21 with essentially equal pressure and volume capacity. This is shown schematically in FIG. 2 with lines B-1 and B-2 from cylinder 19 to cylinder 21.

Figure 4A:
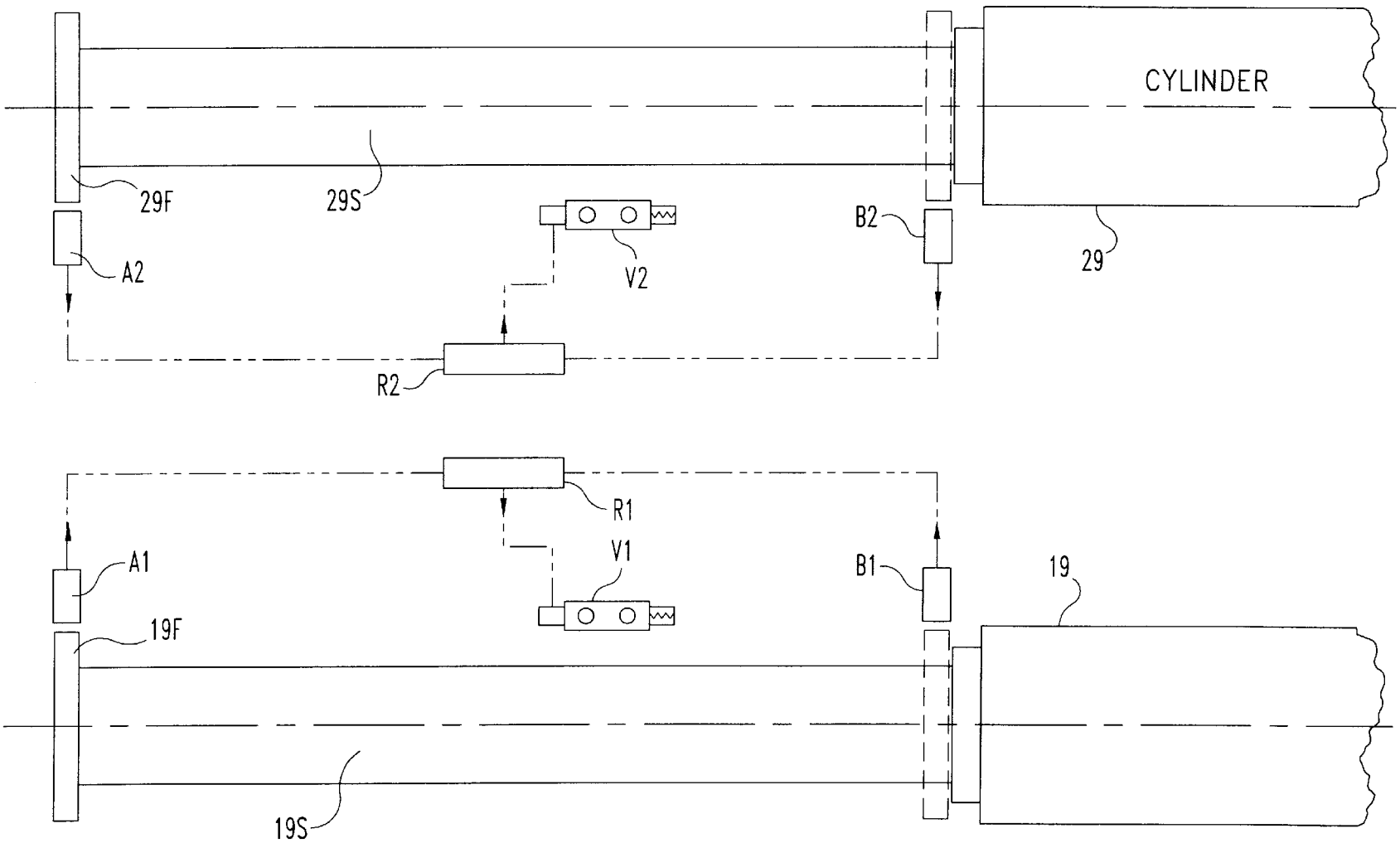
FIGS. 4A through 4D are schematic electrical control component organization diagrams showing steps in the development of the final diagram FIG. 4D.

Referring now to FIGS. 4A through 4D, along with FIG. 3, FIG. 4A is a simplified portion of FIG. 3. It includes a driving cylinder 19 for mud pump cylinder 1, and driving cylinder 29 for mud pump cylinder 2. It also shows the proximity switches A-1 and B-1 associated with the piston rod portion 19S of cylinder 19. Similarly, proximity switches A-2 and B-2 associated with the piston rod 29S of driving cylinder 29, are shown. The position of the rod 19S relative to rod 29S is only for purposes of example, as it is not expected that the pistons of cylinders 1 and 2 will ever be positioned at the same longitudinal location relative to each other unless they are passing as one goes in one direction and the other goes in the other direction. But the purposes of the proximity switches A-1 and B-1 is to limit the travel of the piston in the two directions. Thus, either the switch A-1 or the switch B-1 can set or reset relay R-1 to cause the valve V-1 to shift and switch the high pressure from valve V-1 to either line L-1 to move the driving piston and thereby the mud pump piston 1P to the right, or apply the high pressure to line L-2 and drive the driving piston and thereby, the mud pump piston 1P to the left. Regardless of which direction the mud pump piston is moving, it will be drawing mud from the chip separation tank 6 and discharging it to the manifold connected to discharge line 7. The arrangement and operation is true regarding driving cylinder 29 and the proximity switches and relay R-2 and valve V-2 associated with that piston rod 29S.

To assure that the pistons of the two mud pump cylinders are never at either end limit of their strokes simultaneously, two additional proximity switches C-1 and D-1 (FIGS. 4B and 4D) are added. Each of these can be located about 2 inches, for example, from the proximity switches A-1 and B-1 and functions in the same way as described above with respect to switches A-1 and B-1.

Figure 4B:
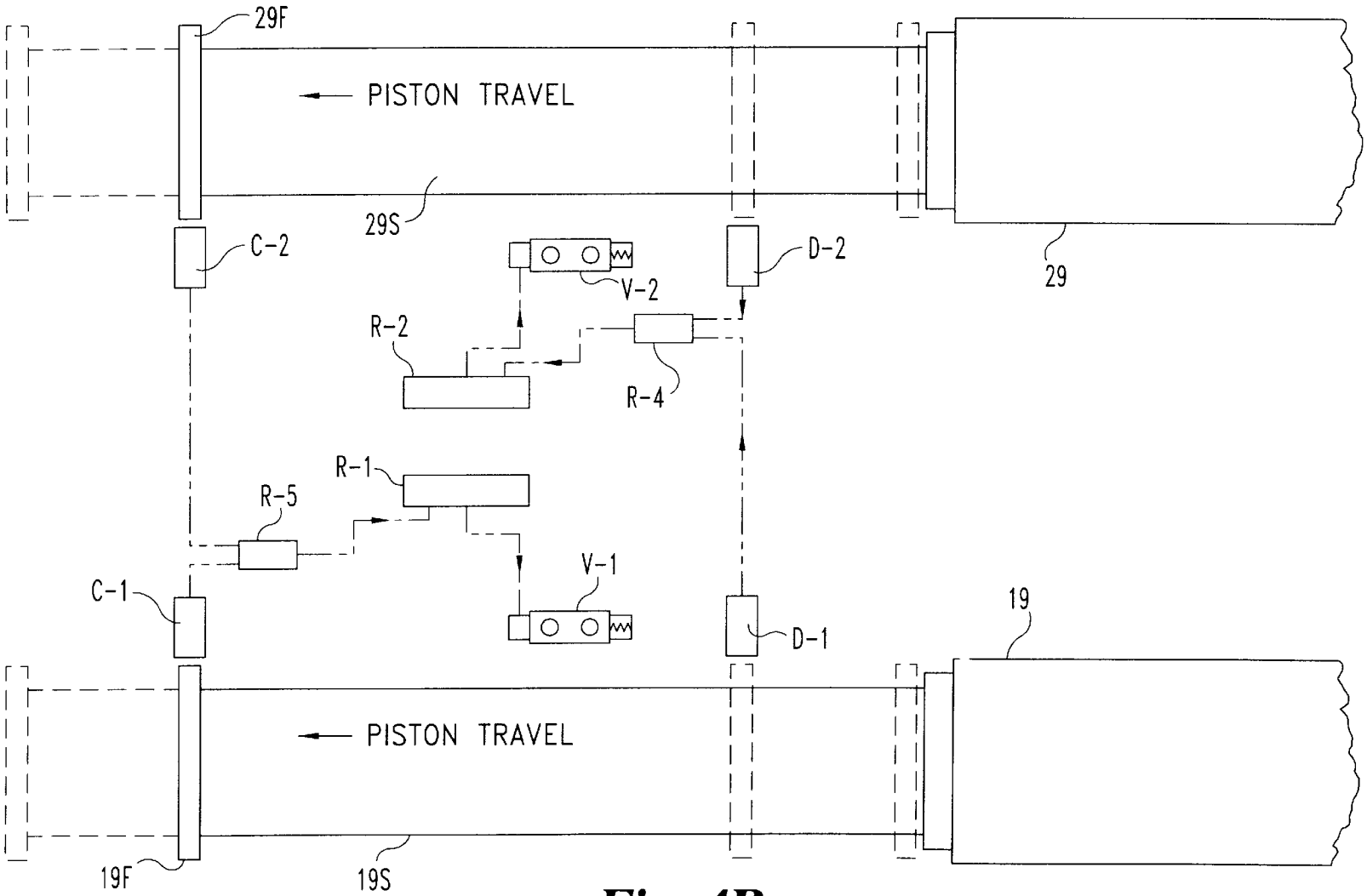
Figure 4C:
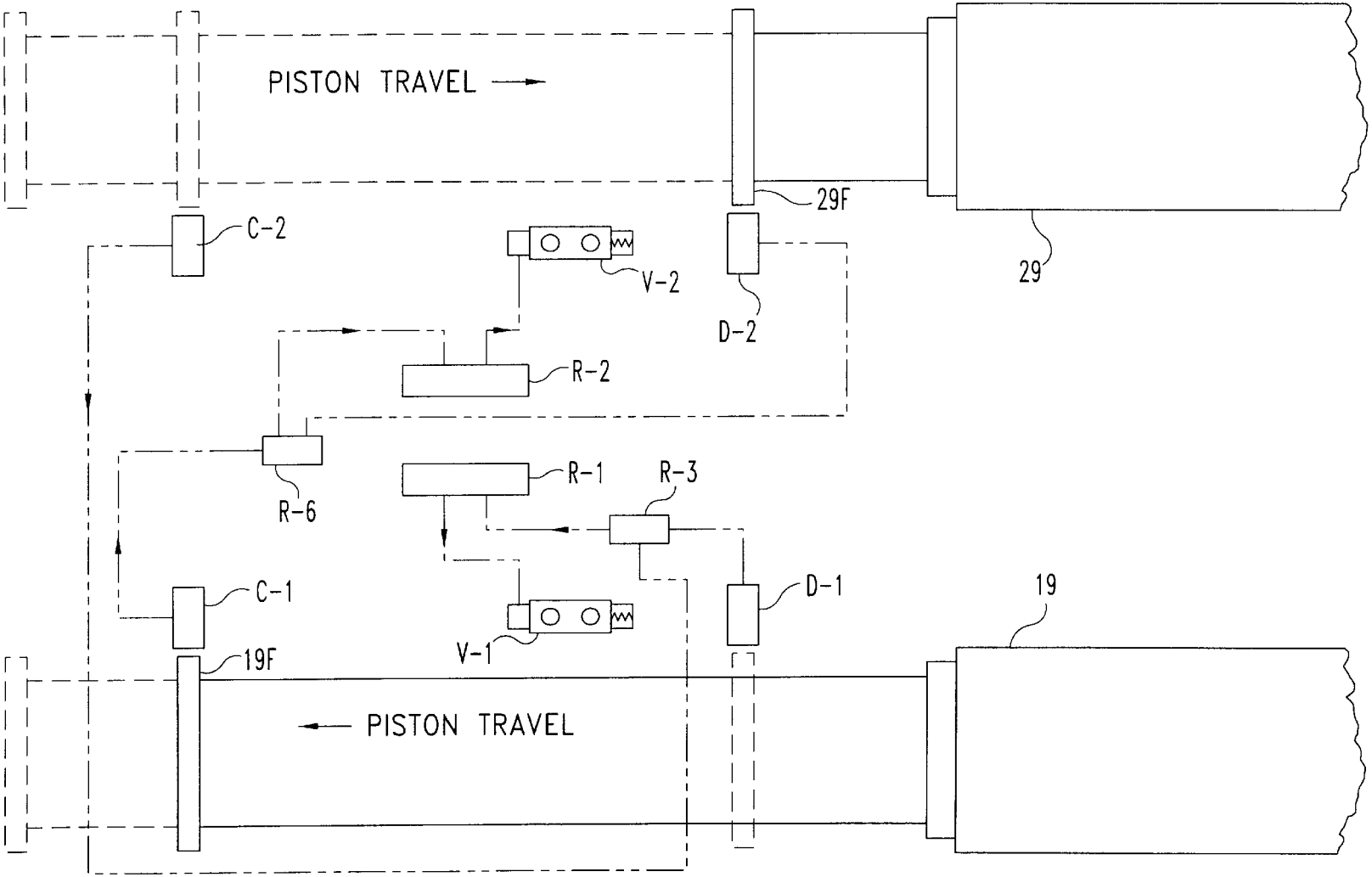
Figure 4D:
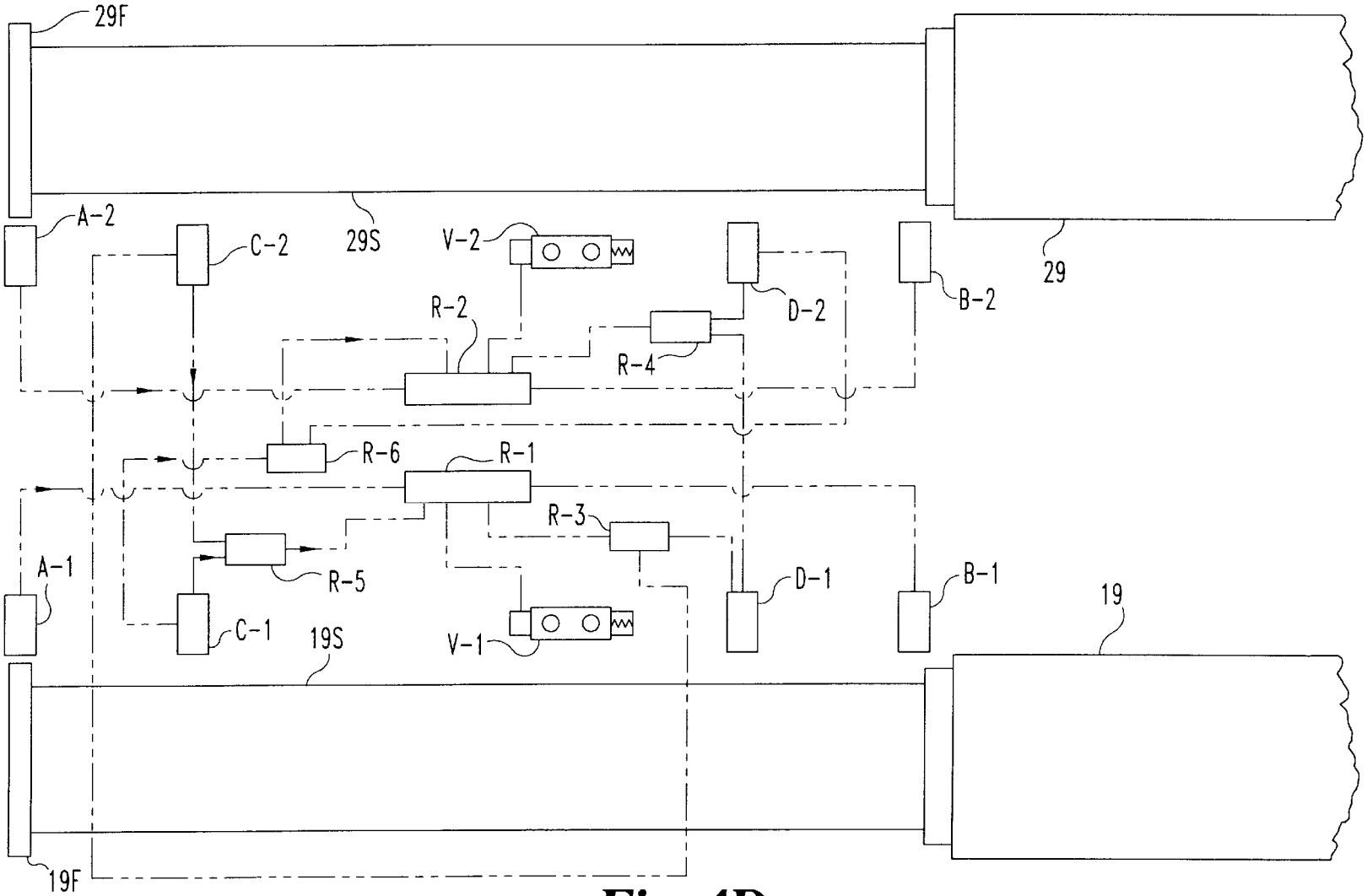

The control system of FIG. 4D provides the combination of components to achieve two objectives. The first, and probably the more important, is to insure that the set of power cylinders 19 and 21 for mud pump cylinder No. 1 will cycle independently of the set of power cylinders 29 and 31 for mud pump cylinder 2, providing a 12 inch stroke for each of the mud pump cylinder rods independently of the other rod. A scheme for accomplishing this is shown generally in FIG. 4A where the sensor A-1 or the sensor B-1 can energize the latching relay R-1 at opposite ends of the piston rod stroke.

Another objective is to build a system which will insure that the piston 1P for mud pump cylinder 1 does not reach the end of its individual stroke at the same time as the piston 2P for mud pump cylinder 2. That could occur when both pistons are side-by-side and going in the same direction (FIG. 4B, for example) or when they are phased 180 degrees apart, so going in opposite directions and nearing the ends of their strokes (FIG. 4C, for example). These conditions are more complex and are addressed by the additional components shown in FIGS. 4B and 4C.

In addressing this problem, it should be recognized that the mud pump pistons could arrive at the ends of their strokes at the same time even if not necessarily together mid-stroke, but they would probably have been together at least a short distance before they reached the ends of their strokes. In FIGS. 4B and 4C and the above description, a two inch distance from the end of the stroke is mentioned and shown, but this distance could be one inch or some other suitable distance. If the two pistons are together a short distance from the end of their strokes, it is likely that they would reach the end of their strokes at essentially the same time.

Since reaching the end of the stroke simultaneously for both mud pump pistons is not desirable, the present invention reverses one of the two pistons prior to reaching the normal end of the stroke. When one piston reverses, its stroke has been limited at 10 inches. This will place the two mud pump pistons out of phase for an extended period. For this purpose, the additional proximity switches C-1 and D-1 for piston rod 19S, and C-2 and D-2 for piston rod 29S, are added, as mentioned above. For the right combination of signals, to correctly use the proximity switches C-1, C-2, D-1 and D-2, additional relays R-3, R-4, R-5 and R-6 can be used. An example is a DP/DT, a stable (non-latching) relay by Siemens, Potter & Brumfield Division.

The combination of the foregoing components for the control functions as described above and shown in FIGS. 4A, 4B and 4C, results in the control component organization of FIG. 4D which is a consolidation of the systems of FIGS. 4A, 4B and 4C, to achieve the above-mentioned goals of having the power cylinder set for mud pump cylinder 1, cycle independently of the power cylinder set for mud pump cylinder 2, and avoiding the simultaneous arrival at the end of their strokes of mud pump piston 1 and mud pump piston 2. At this point it should be understood that specific implementation of controls is not limited to the above-described organization of proximity switches, activators for them, types of valves or relays, whether electrically or pneumatically controlled, or the specific organization of an electrical, pneumatic, or optical control circuit, for example, portions of which may be solid state discrete devices, or integrated circuit organizations, as it will depend largely on the preference of and choices by a control circuit designer and well within the skill of the art of one who understands the organization and intentions and implementation described above, according to the present invention.

Pump Operation

Figure 7:
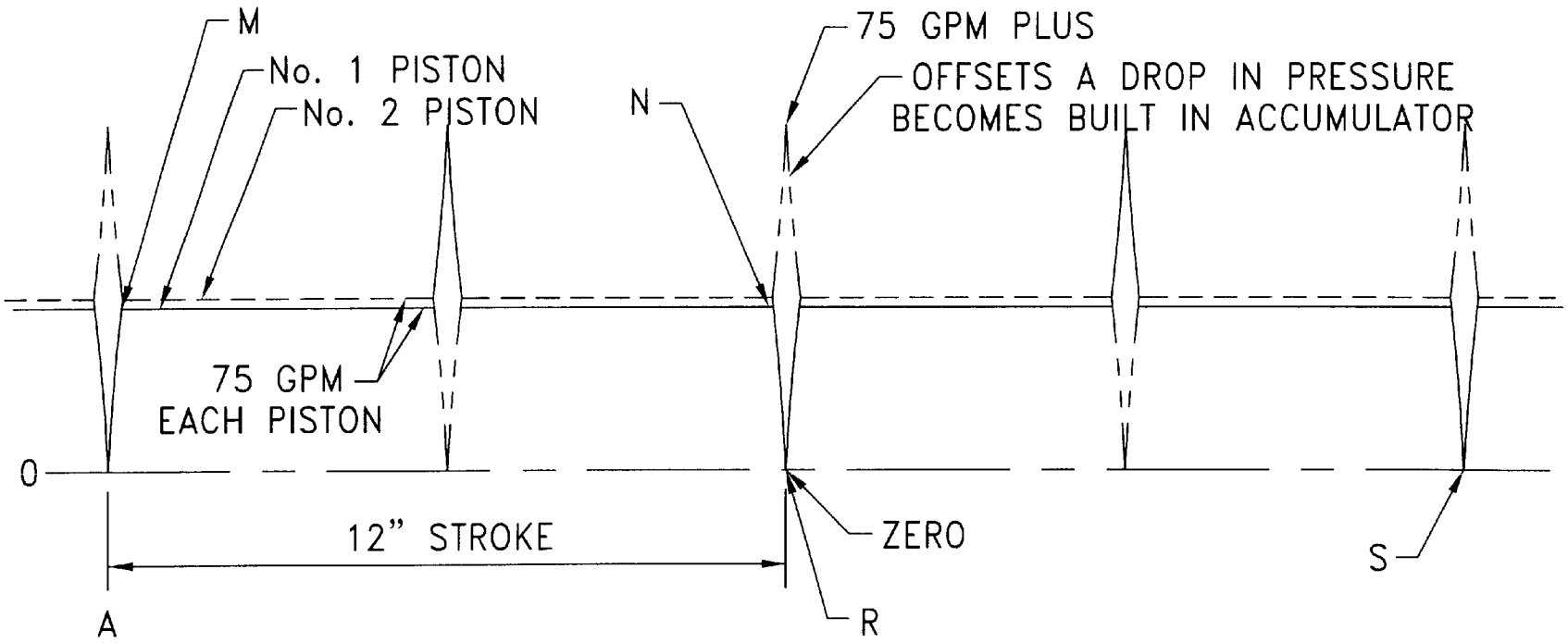
FIG. 7 is a diagram showing theoretical pump driving cylinder piston performance of the two sets of mud pump driving cylinders operating according to the illustrated embodiment of the present invention.

Initially, in the practice of the present invention according to the illustrated embodiment, it is intended that valving and control as shown in FIG. 4D and described above, or in such other scheme as may be preferred, be used so that when a constant flow of hydraulic oil is delivered into the system by the hydraulic pump P, relatively constant mud flow from the double acting duplex mud pump will be possible. With the present invention, the flow divider D (FIG. 1) is truly a flow divider, attempting to deliver the same volume at both outlet ports. To do so, it attempts to adapt to any difference in operation of one of the mud pump pistons relative to the other, by adjusting the pressure. For example, if the piston rod packing in one mud pump cylinder is tighter on the rod than on the other mud pump cylinder, the flow divider spool centering springs will tend to move the spool in a direction attempting to establish the same amount of flow to both of the hydraulic oil driving cylinders. Also, when one mud pump driving cylinder set piston reaches the end of its stroke, what would otherwise appear to be a sharp rise in pressure to be handled by the flow divider, can be tolerated by the flow divider itself so as to avoid damaging mechanical or hydraulic shock. This effect is somewhat mirrored in FIG. 7 which shows in the solid lines, the wave form of pressure available from the mud pump cylinder 1 for one stroke cycle, that being a full stroke from left to right, and a full return stroke from right to left in FIG. 3, for example. The dashed wave form represents the available pressure from mud pump cylinder No. 2. In this illustration, the discharge pressure in cylinder 1 begins a sharp rise from 0 at point A to a maximum available pressure at point M and then drops sharply beginning at point N to 0 at point R. Then it rises on the opposite side of the piston sharply at point R to the same maximum level and then drops again to 0 at point S. Meanwhile, if the pistons of the two mud pump cylinders happen to be operating at 90° phase relationship, the available pressure from the cylinder No. 2 follows the dashed line. Both of these pressure "curves" are essentially a square wave, in contrast to the somewhat sinusoidal output of a conventional, crankshaft-driven duplex piston pump. At point A, when the pistons in the driving cylinders for cylinder 1 get to the end of their stroke, the hydraulic pressure on the driving pistons rises sharply until the pistons begin moving in the opposite direction. This is because of the fact that, when the pistons of either driving cylinder set reach the end of their stroke, and the related solenoid valve is shifting to change the direction of the piston, there is no flow of oil through this valve. With a constant input flow of oil, it must be re-routed to prevent pressure build-up in the system and popping pressure relief valve, and also to prevent a volume drop in the discharge of the mud pump. The flow divider D has tolerance to enable this temporary re-routing to the driving cylinders 29 and 31. At the same time, with the additional pressure on these cylinders driving pump 2, a pressure spike may result in mud pump cylinder 2 such as shown in the dashed line at A and R and S in FIG. 7. The spike could be at other locations, depending upon the phase relationship of the cylinder set for mud pump cylinder 1 and the cylinder set for mud pump cylinder 2. Thus with a less than 100% accuracy-style flow divider D, the excess oil from one shifting solenoid valve is routed to the other (open) solenoid valve and driving cylinder set, which increases in speed and keeps the mud pump discharge constant. The oil itself becomes an accumulator and pressure relief system, operating at the exact same pressure over the full range of the operating system and produces the effect of constant velocity pistons in the mud pump.

Since these driving pistons are not driven by a crank shaft, they operate at essentially constant velocity. In other words, whereas a piston driven by a rotating crank shaft moves according to a harmonic sine wave pattern, a piston driven according to the present invention defines essentially a square wave pattern. In a conventional pump where the piston is driven by a rotating crank shaft, the inlet and outlet valves must be designed and sized to permit maximum flow, which typically occurs at the time of maximum travel of the piston, which occurs when the crank pin axis and rotational axis of the crank shaft are in a plane perpendicular to the axis of the piston. In contrast with construction according to the present invention, the inlet and outlet valves are sized to a maximum flow which is essentially constant regardless of where the piston is during its stroke, and which is only limited by the flow available from the flow divider. Therefore, as an example, where a conventional 5×6 mechanically driven pump using 5×6 valves, would handle about 150 gallons per minute, a pump according to the present invention with a 5" diameter bore and 6" stroke could be expected to produce on the order of 300 gallons per minute although using the same size "5×6" valves. Accordingly, the present invention provides the possibility of approximately twice the volume capacity with significantly less space and weight by virtue of the essentially constant velocity pistons, and significantly less overall length.

Referring again to FIG. 3, with the pump P delivering 36 gallons per minute, for example, the flow divider delivers approximately 18 gallons per minute through each output port, and which is delivered to the hydraulic driving cylinders. It should be understood that pumps having other capabilities in terms of volume and pressure can be employed. The 36 gallon per minute number is selected to match one combination of pump valves and suction hose size. Other combinations can be made for other sizes of suction hose, valves, and operating speeds, and are within the skill of the art. If there is no imbalance in the loads on the pistons of these sets of hydraulic cylinders, each of them can move at the rate determined by 18 gallons per minute flow into the cylinder at 1,000 psi (ignoring friction losses in the lines).

Because of the relative differences in sizes of the driving cylinders and the mud pump cylinders, and again, ignoring friction losses, the mud pump cylinders will be able to deliver 100 gallons per minute at 200 psi.

As suggested above, in the practice of the present invention, the oil of the piston pump system is used to absorb the undesirable pressure peaks of the primary hydraulic system. Resistance of the mud pump hydraulic system can offset the inertia of the traveling pistons and the piston rods when they reach the end of their stroke. The problem of moving excess oil during the time the valve spools are shifting, is addressed to avoid pressure peaks and consequent opening of the relief valves on each stroke. This problem of moving excess oil is solved by using an open system between the two sets of driving pistons. When the control valves close to change the direction of one set of pistons, the oil is free to flow to the other set of pistons which may be in the middle of their stroke operating at the same pressure. The volume of liquid lost in one mud pump cylinder is made up by the increase in the other, insuring that the mud pump discharge remains constant.

An open arrangement, however, can permit one set of pistons to develop more resistance and slow down or even stop. This would double the speed of the other piston. So the open system of the present invention is designed to permit a small amount of oil to flow in either direction, capable of eliminating the pressure peaks, but also capable of urging the two sets of pistons to travel near the same speed. This has been accomplished in the present invention by using the two sets of oil cylinders, two single-spool, two position, closed center valves V-1 and V-2, and a floating piston type of flow divider. This style divider is less than 100% accurate, permitting a small amount of oil to flow in either direction but stabilize the flow close to a 50/50 ratio. The above-mentioned Rexroth flow divider is intended to accomplish this function.

The pressurized side of a hydraulic cylinder is free to accelerate, based on the flow of oil being supplied. But the suction side of a mud pump piston has additional forces. Such piston velocity can only accelerate at a rate based on the flow of liquid moving through the suction valve. When a force is applied to increase the piston to a speed exceeding the incoming flow, increased vacuum forces or cavitation develops and the mud pump cylinder walls tend to deteriorate. Using an open-type system according to the present invention, some portion of supplied driving oil is free to move from the driving cylinder set for the starving cylinder through the flow divider to the driving cylinder set, reducing the acceleration rate and damage to the starving mud pump cylinder walls. Thus in the present invention, the primary hydraulic system can constructively interact with pressures of the secondary, mud management system.

In the water well drilling field, the application of a mud pump requires it to operate from zero to maximum pressure and zero to maximum flow as the drilling proceeds. This eliminates the opportunity to use standard accumulators and limit switches, as such devices must always be preset or designed for a given pressure. By using the open-to-atmosphere concept in the present invention, one of the two hydraulic piston sets is always working against the pressure developed by the resistance of the liquid (mud) being pumped. This liquid thus serves as an accumulator which is always working at the exact pressure required. Since the pressure is a function of the resistance of the fluid and the atmosphere, no relief valve is required.

While, the hydraulic driving cylinders are shown on top and bottom of a mud pump cylinder, other embodiments of the invention might have them beside or otherwise related to the mud pump cylinder as long as the piston rods of the hydraulic cylinders are somehow connected to the piston rod of the mud pump cylinder, so as to drive the mud pump piston. Also, some inventive aspects can be implemented with only a single hydraulic power cylinder for each mud pump cylinder, but using the accommodating flow divider and valve control system disclosed herein. While it is possible to make the cylinders the movable components, and other mixes and mechanical arrangements of rods and cylinders are possible, it is believed that making the rods the movable components simplifies the organization. In summary, the introduction of hydraulic power cylinders into a mud pump according to the present invention, eliminates the use of the complete power end (crankshaft, flywheel, etc.) of a conventional mechanically powered mud pump. Instead the cylinder power source provides a relatively constant velocity piston to move fluid at the piston's rated flow essentially the full length of its design stroke. This permits a pump design with much smaller operating valves than would otherwise be required for the capacity required, contributing to a much smaller unit in size and weight.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A pump system comprising:

a first driving cylinder assembly having a first driving piston therein and a piston rod connected to the first driving piston;

a first driven cylinder assembly having a piston rod connected to the piston rod of the first driving cylinder assembly and driven thereby;

a second driving cylinder assembly having a second driving piston therein and a piston rod connected to the second driving piston;

a second driven cylinder assembly having a piston rod connected to the piston rod of the second driving cylinder assembly and driven thereby;

a source of pressurized hydraulic fluid supply to said first and second driving cylinder assemblies, to drive the said pistons therein;

a first switchable valve coupled between said source and said first driving cylinder assembly and operable, when switched, to reverse the direction that said first driving piston is driven; and a second switchable valve coupled between said source and said second driving cylinder assembly and operable, when switched, to reverse the direction that second driving piston is driven; and the piston rods of all four cylinder assemblies are in parallel, spaced relation to each other.

2. The pump system of claim 1 and further comprising:

a first rod connector member connected to said rods of said first driving and first driven cylinder assemblies and bridging the space between said rods; and a second rod connector member connected to said rods of said second driving and second driven cylinder assemblies and bridging the space between said rods.

3. The pump system of claim 2 and wherein:

connections of the piston rods of the first driving cylinder assembly and the first driven cylinder assembly to said first rod connector member lie in a plane perpendicular to said rods.

4. The pump system of claim 2 and wherein:

the piston rods of said first and second driving cylinder assemblies are of greater diameter than the piston rods of said first and second driven cylinder assemblies, but the diameters of the cylinders of said first and second driving cylinder assemblies are less than the diameters of the cylinders of said first and second driven cylinder assemblies.

5. A pump system comprising:

a first driving cylinder assembly having a first driving piston therein and a piston rod connected to the first driving piston;

a first driven cylinder assembly having a piston rod connected to the piston rod of the first driving cylinder assembly and driven thereby;

a second driving cylinder assembly having a second driving piston therein and a piston rod connected to the second driving piston;

a second driven cylinder assembly having a piston rod connected to the piston rod of the second driving cylinder assembly and driven thereby;

a source of pressurized hydraulic fluid supply to said first and second driving cylinder assemblies, to drive the said pistons therein;

a first switchable valve coupled between said source and said first driving cylinder assembly and operable, when switched, to reverse the direction that said first driving piston is driven; and a second switchable valve coupled between said source and said second driving cylinder assembly and operable, when switched, to reverse the direction that second driving piston is driven; and:

a flow divider coupled between said source and said valves and operable to normally and substantially equalize volume of flow of said hydraulic fluid from said source through each of said valves, said flow divider having a maximum accuracy of 96 percent.

6. The pump system of claim 5 and wherein:

said flow divider has an accuracy in 50—50 flow division no better than four percent error, whereby pressure rise upon flow interruptions by shifting of one or the other of said valves is dissipated by directing additional flow through the flow divider toward the non-shifting other of said valves.

7. A pump system comprising:

a first driving cylinder assembly having a first driving piston therein and a piston rod connected to the first driving piston;

a first driven cylinder assembly having a piston rod connected to the piston rod of the first driving cylinder assembly and driven thereby;

a second driving cylinder assembly having a second driving piston therein and a piston rod connected to the second driving piston;

a second driven cylinder assembly having a piston rod connected to the piston rod of the second driving cylinder assembly and driven thereby;

a source of pressurized hydraulic fluid supply to said first and second driving cylinder assemblies, to drive the said pistons therein;

a first switchable valve coupled between said source and said first driving cylinder assembly and operable, when switched, to reverse the direction that said first driving piston is driven; and a second switchable valve coupled between said source and said second driving cylinder assembly and operable, when switched, to reverse the direction that second driving piston is driven; and first and second piston location sensors associated with said first cylinder and coupled to said first valve to switch said first valve in response to arrival of said first piston in certain locations in its travel;

third and fourth piston location sensors associated with said second cylinder and coupled to said second valve to switch said second valve in response to arrival of said second piston in certain locations in its travel; and first and second relays coupled to selected ones of said sensors and to said valves and responsive to said sensors to switch said valves to control said first and second pistons so that the first and second pistons are always driven out of phase by said hydraulic fluid.

8. A pump system comprising:

first, second and third cylinders with first, second and third pistons and piston rods connected to the pistons therein, said first and second pistons being double acting;

a source of pressurized hydraulic fluid supply to said first and second cylinders, to drive the pistons therein;

the piston rods of said first and second cylinders being connected to each other and to the piston rod of said third cylinder, whereby said first and second cylinder pistons drive the rod and piston of the third cylinder; and a first switchable valve coupled between said source and said first and second cylinders and operable, when switched, to reverse the direction the pistons are driven.

9. The pump system of claim 8 and wherein:

the piston rods of all three cylinders are in parallel, spaced relation to each other.

10. The pump system of claim 9 and further comprising:

a rod connector member bridging the spaces between said rods and connected to said rods to transfer force developed in said first and second cylinders from the pistons thereof to the piston of said third cylinder.

11. The pump system of claim 10 and wherein:

connections of the piston rods to the connector lie in a plane perpendicular to said rods.

12. The pump system of claim 8 and wherein:

the rods of said first and second cylinders are of greater diameter than the rod of said third cylinder, but the diameters of said first and second cylinders is smaller than the diameter of said third cylinder.

13. The pump system of claim 8 and further comprising:

fourth, fifth and sixth cylinders with fourth, fifth and sixth pistons and piston rods connected to the pistons therein, said fourth and fifth pistons being double acting;

said source being coupled to said fourth and fifth cylinders to drive the pistons therein;

the piston rods of said fourth and fifth cylinders being connected to each other and to the piston rod of said sixth cylinder whereby said fourth and fifth cylinders drive the rod and piston of the sixth cylinder; and a second switchable valve between said source and said third and fourth cylinders and operable, when switched, to reverse the direction the pistons of said fourth, fifth and sixth pistons are driven.

14. The pump system of claim 13 and further comprising:

a flow divider coupled between said source and said valves and operable to substantially equalize volume of flow of said hydraulic fluid from said source through each of said valves.

15. The pump system of claim 14 wherein a first set comprises said first and second pistons and a second set comprises said fourth and fifth pistons, the system further comprising:

first, second and third piston location sensors associated with said first cylinder and coupled to said first valve to switch said first valve in response to arrival of said first piston in certain locations in its travel;

fourth, fifth and sixth piston location sensors associated with said fourth cylinder and coupled to said second valve to switch said second valve in response to arrival of said fourth piston in certain locations in its travel; and first and second relays coupled to selected ones of said sensors and to said valves and responsive to said sensors to switch said valves to control the first set and the second set so that the pistons of said first set are always driven out of phase with the pistons of said second set, by said hydraulic fluid.

16. The pump system of claim 15 and further comprising:

fifth and sixth piston location sensors associated with said first cylinder;

seventh and eighth piston location sensors associated with said fourth cylinder; and third, fourth, fifth and sixth relays in couplings of said fifth, sixth, seventh and eighth locations sensors to said first and second relays to enable signals from said sensors to cause the pistons in said first and fourth cylinders to be driven out of phase with each other by said hydraulic fluid.

17. A method of pumping a liquid into a well and comprising:

arranging first and second double-acting liquid-pumping cylinder assemblies with plenums and valves such that the cylinders intake liquid from one plenum and discharge liquid into another plenum regardless of the direction of action of the cylinder assemblies; applying a first double acting driving cylinder assembly to the first pumping cylinder assembly, to drive the first pumping cylinder assembly;

applying a second double acting driving cylinder assembly to the second pumping cylinder assembly, to drive the second pumping cylinder assembly;

powering the driving cylinder assemblies with pressurized hydraulic fluid flowing from a source and normally divided equally 50—50 to the driving cylinder assemblies;

controlling direction of action of said double acting cylinder assemblies by valves between the source and the driving cylinder assemblies, and switching said valves to change action direction of one or another of said driving cylinder assemblies associated with the valves; and enabling increase in rate of flow of hydraulic fluid from said source to one of said driving cylinder assemblies during switching at one of said valves associated with the other driving cylinder assembly and thereby inhibiting pulsations in discharge of liquid into said another plenum.

18. The method of claim 17 and further comprising:

using a floating, normally centered piston, in a flow divider, between the source and the valves to divide the flow equally from the source to the first and second driving cylinder assemblies.

19. The method of claim 18 and wherein the enabling is done by shifting the divider piston off-center in response to pressure rise at the shifting valve to direct additional flow to the other driving cylinder assembly by providing at least four percent error in dividing flow of said hydraulic fluid to said driving cylinder assemblies.

20. The method of claim 17 and wherein the fluid source is regulated to supply said hydraulic fluid at a predetermined pressure and volume rate; and enabling said increase in rate of flow dividing the flow with a flow divider providing at least four percent error from 50—50.

21. The method of claim 17 and further comprising:

controlling said valves to keep the action of said first and second pumping cylinder assembly out of phase.

22. The method of claim 21 and further comprising:

sensing and relating piston location of at least one of said first cylinder assemblies to piston location of at least one of said second cylinder assemblies to control shifting of said valves.

* * * * *